United States Patent [19]

Idota et al.

[11] 4,111,766

[45] Sep. 5, 1978

[54] PROCESS FOR THE RECOVERY OF SILVER FROM FIXING SOLUTIONS

[75] Inventors: Yoshio Idota; Haruo Shibaoka, both of Minami-ashigara, Japan

[73] Assignee: Fuji Photo Film Co., Ltd., Minami-ashigara, Japan

[21] Appl. No.: 717,797

[22] Filed: Aug. 25, 1976

[30] Foreign Application Priority Data

Aug. 25, 1975 [JP] Japan ..... 50-102756

[51] Int. Cl.[2] ..... C25C 1/20

[52] U.S. Cl. ..... 204/109

[58] Field of Search ..... 204/109, 130, 151

[56] References Cited

U.S. PATENT DOCUMENTS 4,021,319 5/1977 Moeglich ..... 204/109

*Primary Examiner*—R. L. Andrews

*Attorney, Agent, or Firm*—Sughrue, Rothwell, Mion, Zinn and Macpeak

[57] ABSTRACT

A process for the recovery of silver from a fixing solution used in processing silver halide photographic light-sensitive materials wherein an electrolytic cell having a cathodic cell and an anodic cell separated by a diaphragm is used; silver is recovered from the used fixing solution in the cathodic cell and the anodic cell is filled with a fixing solution which has been used or not used in photographic processing, or an electrolyzed fixing solution.

30 Claims, 3 Drawing Figures

PROCESS FOR THE RECOVERY OF SILVER FROM FIXING SOLUTIONS

BACKGROUND OF THE INVENTION

1. Field of the Invention

The present invention relates to a process for the recovery of silver from a fixing solution. More particularly, the present invention is concerned with an improved diaphragm electrolysis for the recovery of silver from a used fixing solution.

2. Description of the Prior Art

Fixing, one step of processing silver halide photographic light-sensitive materials, designates the desilverization step using a silver halide dissolving agent. During processing, silver complex salts accumulate in the fixing solution, thus reducing its degree of activity and causing it to exhibit a fatigue phenomenon. This problem can be solved by adding an appropriate amount of a supplemental solution to the fixing solution during processing while discharging used solution as an overflow solution from the fixing apparatus. This method, however, is not preferred in that the discharge of the used solution causes environmental pollution and is not economical. Therefore, if it would be possible to restore the activity of the used solution for re-use thereof in some other fashion, it would be very advantageous.

The following methods of recovering silver are generally known in the art of photography:

(1) depositing silver on cathode in an electrolytic cell (electrolytic process);

(2) bringing the used solution in contact with a metal having a higher ionization tendency than silver (metal substitution process);

(3) adding a reagent capable of forming an inactive silver salt (precipitation process); and (4) using an ion exchange resin (ion exchange process).

The details of these methods are described in M. L. Schreibe, *Present Status of Silver Recovery in Motion-Picture Laboratories,* J. SMPTE, 74, pp. 504 to 514 (1965).

The electrolytic process is widely used since it has the advantages that the silver obtained is of high purity, operation is simple, the apparatus is comparatively cheap, and, in silver recovery, unnecessary by-products accumulate less, thus enabling one to re-use the used solution.

In recent silver recovery, automating of the silver recovery operation and miniaturization of the apparatus have been needed; that is, it has been desired that one need only switch on to start the operation and other processings such as supplying the solution, discharging, starting of electrolysis, stopping, etc., are completely automated, and that such automated apparatus be miniaturized. Thus, the development of a process for the recovery of silver and apparatus therefor meeting the above requirements has been a subjected of extensive research in the art.

On the other hand, while the use of a diaphragm for the electrolytic process is preferred with respect to re-use of the solution, since it very extends the life of the solution, the accumulation of the following three components reduces the life of the solution and thus there are limits.

(1) Components of a developer carried into the solution;

(2) Halogen ions produced during desilverization; and (3) Sulfate ions produced via oxidation of sulfurous acid ions.

Since the accumulation of the above components slows the rate of fixing, etc., the solution must be regenerated by discharging a definite amount of the fixing solution from the system and by adding a regenerating agent to hold the same composition as the unused fixing solution.

Furthermore, the components and amount of the anodic solution in the case where a diaphragm is used should be determined taking into account the stability of the solution obtained via electrolysis and the affects of the solution on photographic properties.

SUMMARY OF THE INVENTION

Accordingly, one object of the present invention is to carry out silver recovery and reproduction of a fixing solution by a diaphragm electrolytic process.

Another object of the present invention is to automate the electrolytic process.

A further object of the present invention is to use a solution capable of providing a stable electrolyzed anodic solution which does not adversely affect photographic elements.

It has now been found that these objects can be attained by using an electrolytic cell having a cathodic cell and an anodic cell separated by a diaphragm, recovering silver from the used solution in the cathodic cell, and further by using as an anodic solution a fixing solution discharged from the system after electrolysis (used or not used for photographic processing, or electrolyzed).

DETAILED DESCRIPTION OF THE INVENTION

Figure 1:
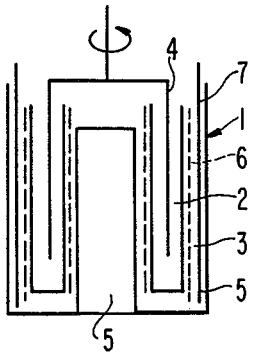
FIG. 1 is a plan view of an electrolytic cell.
Figure 2:
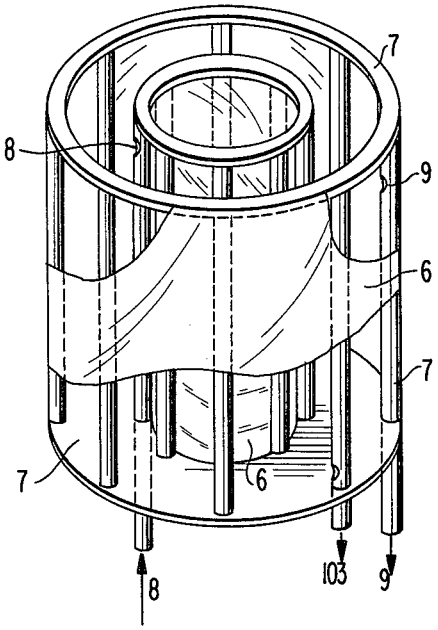
FIG. 2 is a perspective view of a diaphragm support.

The present invention provides a process for the recovery of silver from a fixing solution used in processing silver halide photographic light-sensitive materials by means of an electrolysis, wherein an electrolytic cell having a cathodic cell and an anodic cell separated by a diaphragm is used, silver is recovered from the used fixing solution in the cathodic cell, and the anodic cell is filled with fixing solution which has been used or not used for photographic processing or which has been electrolyzed.

In this process, since the fixing solution contains thiosulfate ions and many other ions, it is possible to effect high current density electrolysis using the same as an electrolyte to effect a highly efficient electrolysis. Phrased somewhat differently, fixing solutions in accordance with the present invention usually comprise one or more thiosulfates. Furthermore, automating the electrolysis is made easy by transferring a definite amount of fixing solution from the cathode to anode cells after electrolysis. In the case that the electrolysis is interrupted, even though the system is allowed to stand for more than 1 day and night, the composition of the cathodic solution remains substantially unchanged and is stable, thus making it possible to automate. In addition, the process of the present invention has many advantages, for example, the fixing solution to be discharged is effectively utilized and thus this process is economically advantageous, and that electrolytic oxidation slightly reduces pollution factors, e.g., COD (chemical oxygen demand).

In more detail, in the fixing process silver is dissolved by a silver halide solvent (typically a thiosulfate, as above indicated), and during fixing a complex salt of silver and thiosulfate accumulates in the fixing solution. Since thiosulfate is complexed, the free thiosulfate decreases, but the total thiosulfate content in the system (complexed thiosulfate plus free thiosulfate) remains substantially constant. In addition, if other materials are present, i.e. sodium sulfite and acetic acid, their content decreases during the fixing process and the pH of the fixing solution changes. However, other components in the fixing solution [refer, for example, to fixing Solution (A)] such as boric acid, ethylene diamine-tetraacetic acid di-sodium salt, aluminum sulfate, sulfuric acid and the like do not alter in content during fixing.

For this reason, when discussing the recovery process of the present invention it is essentially only necessary to consider those components of the fixing solution whose content changes during the fixing process, and components of the fixing solution whose contents do not change need not be considered in any detail.

As one skilled in the art will appreciate, the content of silver in the used fixing solution decreases during electrolysis. Further, the total content of ammonium thiosulfate and sodium sulfite will also be decreased, if they are present, during electrolysis. On the other hand, referring to later described Fixing Solution (A), the acetic acid content is not changed by the electrolysis, while the pH of the solution changes during the electrolysis. In this regard, compare the figures of "at beginning of electrolysis" with those of "after electrolysis" in Table 1, later presented.

After the electrolysis of the present invention, when "make-up" components are added, the regenerated fixing solution substantially approximates the original fixing solution.

By filling the anodic cell with the fixing solution, these many advantages are attained in the diaphragm (electrolytic) process of this invention. Thus, the present process should be distinguished from electrolytic processes in which the anodic cell is not substantially filled with the fixing solution.

While the diaphragm process is known for the production of sodium hydroxide, etc., where it is forcedly applied to the recovery of silver, in particular, from a fixing solution, those skilled in this art have commonly considered that the anodic cell should be filled with electrolyte solutions other than the fixing solution, e.g., a solution of acetic acid and sodium acetate in water. This is because it has naturally been believed that filling the anodic cell with the fixing solution would cause the following problems:

(1) Sulfite ions in the fixing solution would be converted into sulfate ions by oxidation, and the concentration of the sulfite would decrease, finally reaching zero, and when the sulfurous acid ions, which are a stabilizer of a thiosulfate ions, disappear, thiosulfate ions decompose, thus resulting in the precipitation of sulfur.

(2) The volume of the anodic cell should be made considerably large so that the quantity of the sulfite ions is not so small.

(3) The oxidation products of hydroquinone flow into the cell from the fixing solution, whereby the fixing solution turns red.

However it has now unexpectedly been discovered by the inventors that when the anodic cell is filled with the fixing solution, the concentration of the sulfite ion decreases only to about 50% or less of the value calculated by Faraday's law, and when the electrolysis is further continued, it decreases only several percent, and, furthermore, the concentration of thiosulfate ions does not largely decrease (no sulfur precipitates), and thus the volume of the anodic cell need not be made especially large, and the problem of coloration is eliminated by appropriately selecting the diaphragm. Furthermore, the method of the present invention enables one to recover silver more effectively than in the case where other electrolyte solutions are used, and it has many advantages as described above.

Generally, for the first electrolysis, the anodic material will be the original fixing solution, whereas from the second electrolysis on the anodic material will be regenerated fixing solution.

In the method of the present invention, it is preferred that the solution of the anodic cell not be stirred and come into contact with the air as little as possible. There is no need to seal the apparatus in any specific fashion, but it is preferred that stirring and aeration be avoided because such will accelerate any decrease in the concentration of $Na_2SO_3$.

The present invention will now be described by way of example with reference to the accompanying drawings. In the figures, like numerals are utilized to identify like elements, unless otherwise specifically indicated.

In FIG. 1, electrolytic cell 1 comprises a cathodic cell 2, an anodic cell 3, cathode 4, anode 5, a diaphragm 6 separating the cathodic cell 2 and the anodic cell 3, and a diaphragm support 7. Not shown in FIG. 1 is conventional rotation means to rotate the cylindrical cathode; the anode is not rotated. The details of the diaphragm support are described in Japanese Utility Model Application No. 23856/1975 (see also U.S. application Ser. No. 660,385, hereby incorporated). Thus, it is unnecessary to explain the same in detail. The supply and discharge of the used solution are carried out, respectively, through conducts 8 and 9, respectively, and the used solution is circulated through circulation tank 10 and regenerated.

The electrolytic cell and the diaphragm support are suitably made of an insulating material such as glass, hard rubber, wood, or a synthetic resin. In particular, synthetic resins such as polyvinyl chloride, polymethyl methacrylate, polyethylene, polypropylene, polystyrene, and a phenol-formaldehyde resin are preferred.

On the other hand, the cathode may acceptably be made of a conductor or semiconductor which is durable to long use or repeated use. In particular, a stainless steel is preferred, though other useful cathode materials include titanium, titanium alloys e.g., titanium-aluminum alloy, titanium-chromium alloy, etc., iron, silver, tin, lead, aluminum, and the like.

The anode is acceptably made of a material which does not melt under an applied voltage. In more detail, carbon (graphite), lead dioxide, platinum, gold, titanium coated steel, and the like can be used. In particular, an anode made of carbon is advantageously used.

The shape of the electrodes may be freely selected depending on the apparatus design, and can be any of a plate (including circular plate), rod, cylinder, and fiberlike shape. In general, both the cathode and the anode are preferably in the form of a plate or cylinder.

The diaphragm is preferably made of a material which allows ions and liquid to pass therethrough, but which does not allow molecules to pass therethrough. Suitable examples of such materials include membranes (e.g., cellulose acetate whose surface is hydrolyzed, cellophane, a copper ferrocyanide film, a bladder film, an intestinal wall film, an agar film, and the like), an asbestos plate, a porous tile, most preferably having a pore size of about 0.1 mm, sintered glass, glass wool, fine porous polymer films (most preferably having a pore size of about 0.1 to about 0.7 μm, e.g., a polyvinyl chloride film, a polystyrene film, a polysulfone film, a polyester film, a polypropylene film, and the like), etc.

As one skilled in the art will appreciate from the above discussion, the essential characteristics of any diaphragm utilized is that it have a pore size capable of passing an ion but preventing the passage of electrolyte. Usually, the diaphragm pore size is from about 0.1 μm to about 0.1 mm, more preferably 0.1 μm to 0.5 μm.

Figure 3:
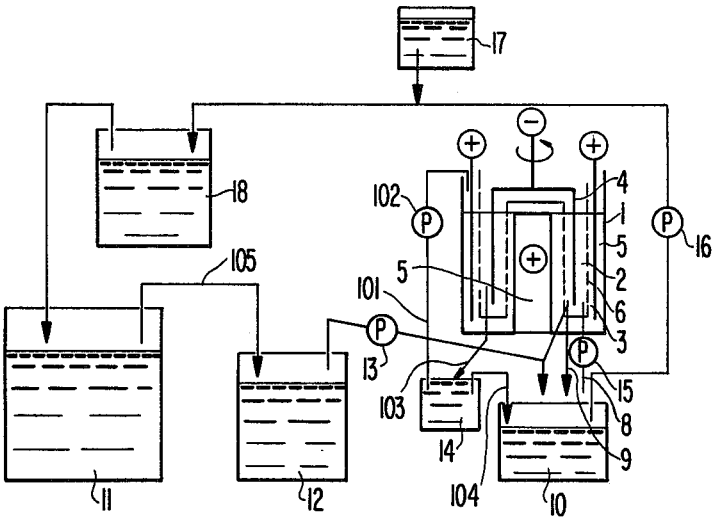
FIG. 3 is a flow diagram illustrating an embodiment of reproduction in accordance with the present invention.

Turning now to FIG. 3, the used fixing solution is pumped from overflow solution tank 12 into circulation tank 10 via pumps 13 (it will be noted that the line existing from pump 13 is later split into two lines; one line supplies solution to cell 2 and the other line supplies solution to tank 10) and then into cathodic cell 2. Used fixing solution is, of course, overflown from tank 11 to tank 12 via line 105. Overflow solution tank 12 receives overflowing solution from the fixing tank 11 which is not per se a part of the developing apparatus, of course. Used fixing solution in circulation tank 10 is pumped into cathodic cell 2 via line 8 and pump 15, and used fixing solution is returned from cathodic cell to circulation tank 10 via line 9. Used fixing solution thus circulates between circulation tank 10 and cathodic cell 2. The anodic cell 3 is previously filled with the fixing solution. When a definite amount of the used fixing solution has been introduced, a circulation pump 15 is activated and the preparation prior to electrolysis is completed. As earlier indicated, the purpose of circulation pump 15 is to circulate used fixing solution between cathodic cell 2 and circulation tank 10. When the volume of cathodic cell 2 is smaller than the volume of the used fixing solution to be electrolyzed, pump 15 is necessary to control the amount of the solution being charged from circulation tank 10 to cathodic cell 2. On the other hand, when the volume of cathodic cell 2 is greater than the volume of the fixing solution to be electrolyzed, pump 15 can essentially be omitted from the system. Thereafter, when an electric current is passed through the system, desilverization and liquid-regeneration proceeds in the cathodic cell 2. After the electrolysis is carried out for a definite period of time (preferably, the time for the amount of residual silver to reach 0.5 g/l), the anodic solution is discharged from the system, essentially as waste. The cathodic solution is returned via line 103 to a constant quantity cup 14 and thence to the curculation tank 10 via line 104. The volume of the constant quantity cup 14 is determined by the amount to be discharged out of the system, the volume of the anodic cell, the concentration of the sulfurous acid ion in the fixing solution, the time of electrolysis, and the electric current density. It is to be noted, in this regard, that when the volume to be discharged from the anodic cell, the volume of the constant quantity cup 14, the volume of the regeneration solution from tank 17 and the volume of the anolyte are all equal (hereafter, this volume is represented as volume $V_1$), the supply of constant supplemental solution is insured.

The fixing solution can be used as the anodic solution until the amount of the sulfite ions (stabilizer) reaches 0 through electrolysis, etc., and the thiosulfate acid ions are converted into sulfur. The minimum volume of anodic cell is not less than 0.5 liter, and the maximum volume of the anodic cell is 50 volume % of the used fixing solution to be electrolyzed. On a practical scale, 0.5 liter is the minimum volume of the electrolyte solution sent to waste, which is equal to the minimum volume of the anodic cell. At a lesser volume, one is essentially dealing with an apparatus which is too small to be practically useful to process large amounts of fixing solution. The minimum volume of the anodic cell will also be equal to the minimum volume to be discharged from the system (i.e., the minimum volume sent to waste). The fixing solution remaining in the constant quantity cup 14 is pumped into the anodic cell 3 and is made ready for the next electrolysis. When the fixing solution (anodic solution) has no sulfite ions, the thiosulfate ions are converted to sulfur. The life of the fixing solution being used as the anodic solution depends on the current density and the volume of the anodic solution, as one skilled in the art will appreciate. The fixing solution remaining in the constant quantity cup 14 is pumped into the anodic cell 3 by way of line 101 and pump 102.

Where the anolyte is allowed to stand in the anode compartment for a long period of time, the overflow solution is again introduced. Since the anodic solution is the regenerated fixing solution, there is no danger of other ingredients being intermixed; thus, the present method is advantageous for this reason.

The regenerated fixing solution is pumped via pump 16 from the circulation tank 10. A regeneration agent is added thereto from a regeneration agent tank 17, and then the regenerated fixing solution is conveyed into a replenisher tank 18 (which stores replenishing solution before supplying the same into fixing tank 11) and then into a fixing tank 11. In this way, the regeneration process is completed.

For instance, assuming that the total volume of fixing solution to be electrolyzed is represented as V, and the volume discharged from the anodic cell is $V_1$, the volume of the solution passing through pump 16 will be $V-V_1$, and the volume of the regeneration agent solution will be $V_1$. The total volume of material introduced into tank 18 will be $(V-V_1)+V_1=V$. Since the composition of the fixing solution introduced into tank 18 must be substantially the same as the composition of the original fixing solution, the regeneration agent solution typically contains ammonium thiosulfate, sodium sulfite, acetic acid and a pH adusting agent to supplement the amount lost in fixing and electrolysis. Of course, if desired, the regeneration agent solution can contain other components (e.g., boric acid, ethylenediamine tetraacetic disodium salt, aluminum sulfate, sulfuric acid and the like), and generally will contain these components, since these components will be carried out from the system with the solution to waste, i.e., solution discharged from anodic cell 3, and must be made-up for efficient operation. By repeating the above operation, it is possible to repeat regeneration for long periods of time.

Turning in somewhat more detail to the relationship between line 103, constant quantity cup 14, line 104 and circulation tank 10 as shown in the FIG. 3, line 103 interconnects constant quantity cup 14 and cathodic cell 2. Typically, a conduit opened at the top extends a certain height into constant quantity cup 14 from the bottom thereof. Constant quantity cup 14 is thus filled with liquid until the top of the conduit (which can be adjustable in height) is reached, whereafter liquid overflows into the conduit and to line 104 into circulation tank 10. Assuming that the height of the top of the conduit is fixed, solution will also remain in the constant quantity cup 14 in a constant volume (the volume is set to be volume $V_1$, as earlier discussed).

As will be apparent from the earlier offered discussion, when solution is circulated using pump 15, pump 16 is stopped. After the electrolysis is complete, pump 15 is stopped and solution remaining in cathodic cell 2 is transported via line 103, constant quantity cup 14, line 104, tank 10 and pump 16 into tank 18. Solution remaining in constant quantity cup 14 (having a volume of $V_1$) is transported via line 101, pump 102 and into anode cell 3. At this stage, one is ready to initiate a further process run.

From the above discussion, one skilled in the art will appreciate that the electrolysis conditions utilized can vary widely, depending upon the exact system under consideration. For example, the current density selected can be varied greatly depending on the form and shape of the electrolytic cell. Most generally, however, it is on the order of about 0.05 to about 1 A/dm$^2$, even more preferably from 0.1 to 0.4 A/dm$^2$.

Utilizing a current density as above, it is preferred to use an average voltage of on the order of about 0.3 to about 3 volts, even more preferably 0.5 to 1.5 volts.

The total time for the electrolysis can be calculated from Faraday's Law (assuming the electrolytic efficiency is 100%); for example, 2.5 hours are required to recover 100 g of silver using a 10 A/dm$^2$ current density.

Since little is to be gained by heating or cooling the fixing solution subjected to treatment in accordance with the present invention, typically operation is at ambient conditions, i.e., between about 5° C. and about 30° C. At this temperature range, the percentage recovery does not change (it is constant) when constant current is utilized.

While nothing would prohibit practicing the process of the present invention at sub- or super-atmospheric pressue, nothing is gained thereby, and, accordingly, the process of the present invention is typically practiced at atmospheric pressure.

The ratio of anolyte to the solution in the cathodic cell (not the catholyte) can be varied over a wide range, but on a commercial scale excellent results are obtained when this ratio is (by volume) 1: about 2 to about 3.

The ratio of the cathode area to the anode area is not important, and can be freely selected applying the average skill in the art.

In the method of the present invention, the solution to be regenerated through electrolysis is a fixing solution used in photographic processing, while the anodic solution is a fixing solution which has been used or not used in photographic processing or a fixing solution which has been subjected to the electrolysis.

The fixing solution contains one or more of silver halide solvents such as thiosulfuric acid salts, e.g., sodium thiosulfate, potassium thiosulfate, ammonium thiosulfate, and the like; thiocyanic acid salts, e.g., sodium thiocyanate, potassium thiocyanate, ammonium thiocyanate, and the like; thioureas, e.g., thiourea, ethylene thiourea, and the like; water-soluble sulfur-containing diols, e.g., 3-thia-1,5-pentanediol, 3,6-dithia-1,5-pentanediol, 3,6,9-trithia-1,11-undecanediol, and the like; water-soluble sulfur-containing organic dibasic acids, e.g., thioglycolic acid, ethylenebisthioglycolic acid, and the like; etc.

It may further contain, if desired or necessary for various purposes, a preservative, e.g., sodium sulfite, potassium sulfite, potassium metabisulfite, and the like; a pH adjustor, e.g., acetic acid, sodium acetate, sodium hydroxide, sodium carbonate, sodium borate, tartaric acid, maleic acid, propionic acid, and the metal salts thereof, and the like; a hardener, e.g., aluminum alum, aluminum sulfate, chromium alum, zirconium sulfate, and the like; a chelating agent, e.g., ethylenediamine tetraacetic acid, nitrilotriacetic acid and/or the sodium salts thereof, and the like; and other auxiliary agents, e.g., boric acid, urea, lower alkanolamines, ammonia water, and the like.

While the method of the present invention is preferably employed for a continuous automatic electrolytic regneration, it may be batch-wise carried out. Moreover, the method of the present invention may be used in combination with a method whereby accumulations such as those compounds carried thereinto from a preceeding bath, those compounds dissolved in the fixing solution from the light-sensitive material, and the like are removed with activated carbon, an ion exchange resin, etc., prior to the repeated use thereof.

The method of the present invention can be applied to processing all kinds of light-sensitive materials such as black and white or color negative, positive, reversal or direct-positive light-sensitive materials, lith-type light-sensitive materials, light-sensitive materials for radiation, particularly rays, autoradiograph light-sensitive materials, silver dye bleaching color light-sensitive materials, and the like, so long as silver halide is used therein.

The present invention will be explained with reference to the examples as hereinafter described, in which the electrolysis was conducted under the following conditions: the cathode rotation cylinder type as shown in FIG. 1 was used as the electrolytic cell, the cathode and anode were made of stainless steel and graphite, respectively, their effective areas being 30 dm$^2$ and 35 dm$^2$, respectively, and, as the diaphragm, a thin polymer film of polyethylene chloride and polystyrene was used (film thickness: 0.01 to 0.05 mm; pore size: 0.1 to 0.7 $\mu$m); as the anodic solution, fixing solution (A) as later defined and, for comparison, solution (B) similar to (A) and having sufficient electrical conductivity, i.e., comprising 140 ml/l of acetic acid, 82 g/l of sodium acetate, and 300 g/l of sodium sulfate, and a pH of 4.1, were used in an amount of 3 liters, respectively. In the case of (A), the constant current density was 0.2 A/dm$^2$ (6 A) and the average voltage between the cathode and anode was 0.8 V, whereas in the case of (B), since the cathodic solution (used fixing solution) was converted into sulfur at a constant current density of 0.2 A/dm$^2$, the average current density was 0.07 A/dm$^2$ (2 A) and the constant voltage between the cathode and anode was 1.0 V. It is apparent that (A) is advantageous in that it is possible to pass a high electrical current. In this example, the cathode was cylindrical and was rotated during the regeneration at a constant rate of rotation in the area of 40 to 300 rpm. Rotation is optional and the exact rate of rotation chosen is not overly important; it merely provided a somewhat increased electrolysis efficiency.

EXAMPLE 1

Onto both sides of a polyethylene terephthalate film were coated silver (as silver halide) and gelatin in amounts of 20 mg/100 $cm^2$ per side and 25 mg/100 $cm^2$ per side, respectively, to provide thereon gelatin-silver iodobromide emulsion layers (silver iodide: 1.5 mole %; gelatin: 50 g per mole of silver halide). On these emulsion layers was further coated gelatin in an amount of 10 mg/100 $cm^2$ to provide thereon gelatin protective layers, whereby a photographic light-sensitive material was obtained.

This light-sensitive material was exposed to light and then processed with a roller conveyor type processor as follows:

| | Processing Temp. (° C) | Processing Time (sec.) |
|---|---|---|
| Development | 35 | 23 |
| Fixing | 33 | 23 |
| Washing with water | 33 | 23 |
| Drying | 50 | 21 |

The compositions of the developing solution and the fixing solution were as follows:

| Developing Solution | |
|---|---|
| Water | 500 ml |
| Hydroxyethylethylenediaminetri-acetic Acid | 0.8 g |
| Sodium Sulfite (anhydrous) | 50.0 g |
| Potassium Hydroxide | 20.0 g |
| Hydroquinone | 25.0 g |
| 1-Phenyl-3-pyrazolidone | 1.5 g |
| Boric Acid | 10.0 g |
| Triethyleneglycol | 25.0 g |
| Glutaraldehyde | 5.0 g |
| Potassium Bromide | 6.0 g |
| Glacial Acetic Acid | 3.0 g |
| Sodium Bisulfite (anhydrous) | 4.5 g |
| 5-Nitroindazole | 0.03 g |
| 1-Phenyl-5-mercaptotetrazole | 0.005 g |
| 5-Methylbenzotriazole | 0.005 g |
| Water to make | 1.0 liter |

This developing solution has about a 10.3 pH at 20° C.

| Fixing Solution (A) | |
|---|---|
| Water | 500 ml |
| Ammonium Thiosulfate | 200.0 g |
| Sodium Sulfite (anhydrous) | 20.0 g |
| Boric Acid | 8.0 g |
| Ethylenediamine Tetraacetic Acid Di-sodium Salt | 0.1 g |
| Aluminum Sulfate | 15.0 g |
| Sulfuric Acid | 2.0 g |
| Glacial Acetic Acid | 22.0 g |
| Water to make | 1.0 liter |

The fixing solution had about a 4.10 pH at 20° C.

Used fixing solution in an amount of 20 l was subjected to electrolysis for 6.3 hours, and at the beginning of the electrolysis, after the electrolysis, and after being allowed to stand for 18 hours, the solutions in the cathodic compartments, where the (A) and (B) solutions were used as the anolytes, respectively, were analyzed. The results obtained are shown in Table 1.

Table 1

| Component | Anodic Sol. | At the Beginning of Electrolysis | After Electrolysis | After being Allowed to Stand for 18 hrs. |
|---|---|---|---|---|
| Silver | A | 8.0 g/l | 0.5 g/l | 0.5 g/l |
| | B | 8.0 g/l | 5.5 g/l | 5.2 g/l |
| Ammonium Thiosulfate | A | 200.0 g/l | 199.0 g/l | 199.0 g/l |
| | B | 200.0 g/l | 196.8 g/l | 195.0 g/l |
| Sodium Sulfite | A | 18.0 g/l | 17.4 g/l | 16.2 g/l |
| | B | 18.0 g/l | 17.0 g/l | 14.0 g/l |
| Acetic Acid | A | 3.0 g/l | 3.0 g/l | 3.0 g/l |
| | B | 3.0 g/l | 3.5 g/l | 5.5 g/l |
| pH | A | 4.15 | 4.13 | 4.10 |
| | B | 4.15 | 4.09 | 4.00 |

The changes in composition after being allowed to stand for 18 hours in the apparatus are due to the exchange of the anodic solution due to transmission via the diaphragm, and air oxidation, Table 1 shows that the changes are larger in the case of the (B) solution. The changes in composition after electrolysis and after being allowed to stand for 18 hours show that the (A) solution is excellent at all points. This capability is important, for example, in the case that electrolysis is interrupted due to a power failure or working hours end before an electrolysis is completed. If the composition of the catholyte were to change, it would be impossible to easily reuse the changed solution to obtain reproducible results.

Where the solution obtained by the method of the present invention is used as the "make-up" solution, the amounts of silver and sodium thiosulfate remaining on the film were, respectively, 15 $\mu g/cm^2$ and 48 $\mu g/cm^2$. These results, including the drying results, i.e., the dry state of the film, show that the method of the present invention provides good results.

In the case of fixing solution (A), both batch and continuous operation can be used. On the other hand, in the case of fixing solution (B), only batch operation can be practiced.

EXAMPLE 2

In this Example, the processing method followed was the same as in Example 1, but the time was different. However, since the amount of silver on the multi-layer colored paper and the treating ability of the fixing solution therefor differed, the amount of silver carried into the solution was different. Accordingly, the time of electrolysis (preferably, the time for the amount of residual silver to reach 0.5 g/l) differed.

A multi-layer color paper comprising three silver halide emulsion layers, each containing a color coupler in the emulsion and having a different light-sensitive region, was image-wise exposed and developed. The thus prepared color negative film was printed with an automatic printer and then subjected to the following treatment in a roller conveyor type automatic developing machine.

| Treatment | Temp. (° C) | Time (Min.) | Amount of processing solution (liters) |
|---|---|---|---|
| Color Development | 30 | 6 | 30 |
| Stop-Fixing | " | " | 10 |
| Washing with water | " | 2 | — |

-continued

| Treatment | Temp. (° C) | Time (Min.) | Amount of processing solution (liters) |
|---|---|---|---|
| Bleach-Fixing | " | " | 10 |
| Washing with water | 30 | 2 | — |
| Stabilizing Bath | " | " | 10 |

The compositions of the processing solutions used are shown below.

| | |
|---|---|
| Color Developing Solution | |
| Benzyl Alcohol | 12 g |
| Diethyleneglycol | 3.5 g |
| Sodium Hydroxide | 2.0 g |
| Sodium Sulfite | 2.0 g |
| Potassium Bromide | 0.4 g |
| Sodium Chloride | 1.0 g |
| Borax | 4.0 g |
| Hydroxylamine Sulfuric Acid Salt | 2.0 g |
| Disodium Ethylenediamine Tetraacetic Acid, dihydrate | 2.0 g |
| 4-Amino-3-methyl-N-ethyl-N-(β-methanesulfoneamidoethyl)anilinosesquisulfate-monohydrate | 5 g |
| Water to make | 1 liter |
| Stop-Fixing Solution | |
| Sodium Thiosulfate | 70 g |
| Ammonium Thiosulfate (70%) | 30 ml |
| Sodium Acetate | 5 g |
| Acetic Acid | 30 ml |
| Sodium Sulfite | 10.0 g |
| Potassium Alum | 15 g |
| Water to make | 1 liter |
| Bleach-Fixing Solution | |
| Ferric Sulfate | 20 g |
| Disodium Ethylenediamine Tetraacetic Acid, dihydrate | 36 g |
| Sodium Carbonate (monohydrate) | 17 g |
| Sodium Sulfite | 5 g |
| 70 wt% Aqueous Solution of Ammonium Thiosulfate | 100 ml |
| Boric Acid | 5 g |
| The pH adjusted to 6.8; | |
| Water to make | 1 liter |
| Stabilizing Solution | |
| Boric Acid | 5 g |
| Sodium Citrate | 5 g |
| Sodium Metaborate (tetrahydrate) | 3 g |
| Potassium Alum | 15 g |
| Water to make | 1 liter |

Following the procedure of Example 1, 20 liters of the stop-fixing solution used was subjected to electrolysis for 3.75 hours, and, at the beginning of the electrolysis, after the electrolysis, and after being allowed to stand for 18 hours, changes in composition of the solutions in the cathodic compartments, wherein the (A) and (B) solutions were used as the anolytes, respectively, were measured. The results obtained are shown in Table 2.

Table 2

| Component | Anodic Sol. | At the Beginning of Electrolysis | After Electrolysis | After being Allowed to Stand for 18 hrs. |
|---|---|---|---|---|
| Silver | A | 5.0 g/l | 0.5 g/l | 0.5 g/l |
| | B | 5.0 g/l | 3.5 g/l | 3.3 g/l |
| Sodium Thiosulfate | A | 70.0 g/l | 69.9 g/l | 69.9 g/l |
| | B | 70.0 g/l | 69.5 g/l | 68.8 g/l |
| Sodium Sulfite | A | 9.5 g/l | 9.2 g/l | 8.7 g/l |
| | B | 9.5 g/l | 8.5 g/l | 7.5 g/l |
| Acetic Acid | A | 30 ml/l | 30 ml/l | 30 ml/l |
| | B | 30 ml/l | 32 ml/l | 38 ml/l |

Table 2-continued

| Component | Anodic Sol. | At the Beginning of Electrolysis | After Electrolysis | After being Allowed to Stand for 18 hrs. |
|---|---|---|---|---|
| pH | A | 4.80 | 4.78 | 4.75 |
| | B | 4.80 | 4.74 | 4.60 |

As in Example 1, the results of Table 2 show tht the use of the (A) solution provides better results.

Where the solution obtained by the method of the present invention was used as the supplemental solution, good photographic properties were obtained.

While the invention has been described in detail and with reference to specific embodiments thereof, it will be apparent to one skilled in the art that various changes and modifications can be made therein without departing from the spirit and scope thereof.

What is claimed is:

1. A process for the recovery of silver from a fixing solution used in processing a silver halide photographic light-sensitive material comprising subjecting the used fixing solution to electrolysis at a current density of about 0.05 to about 1 A/dm$^2$ in an electrolytic cell, wherein the electrolytic cell comprises a cathodic cell and an anodic cell separated by a porous polymer film having a pore size of about 0.1 to about 0.7 microns, the silver is recovered from the used fixing solution in the cathodic cell, and the anodic cell is filled with i. a fixing solution which as been used in photographic processing;

ii. a fixing solution which has not been used in photographic processing; or iii. a fixing solution which has already been subjected to the electrolysis wherein said solution (i), (ii) or (iii) in the anodic cell contains ammonium ion.

2. The process according to claim 1, wherein the electrolytic cell is made of an insulating material.

3. The process according to claim 2, wherein the insulating material is a synthetic resin.

4. The process according to claim 1, wherein the cathode is made of stainless steel.

5. The process according to claim 1, wherein the anode is made of graphite.

6. The process according to claim 1, wherein the fixing solution in the cathodic and anodic cells contains ammonium thiosulfate.

7. The process according to claim 1, wherein said current density is 0.1 to 0.4 A/dm$^2$.

8. The process according to claim 1, wherein the solution (i), (ii) or (iii) in the anodic cell is not stirred.

9. The process according to claim 1, wherein said electrolysis is conducted under constant current.

10. The process according to claim 1, wherein the polymer of said polymer film is selected from the group consisting of polyvinyl chloride, polystyrene, polysulfone, polyester or polypropylene.

11. The process according to claim 1, wherein the volume ratio of the solution (i), (ii) or (iii) in the anodic cell to the used fixing solution in the cathodic cell is 1:about 2 to 1:about 3.

12. The process according to claim 1, wherein sulfite ion is present in the solution (i), (ii) or (iii) in the anodic cell and said electrolysis is terminated before the concentration of said sulfite ion reaches zero.

13. A semicontinuous and cyclic process for the recovery of silver from a fixing solution used in processing a silver halide photographic light-sensitive material comprising:

(a) subjecting to electrolysis at a current density of about 0.05 to about 1 $A/dm^2$ an electrolytic cell comprising a cathodic cell and an anodic cell separated by a porous polymer film having a pore size of about 0.1 to about 0.7 microns wherein said used fixing solution is the catholyte and anolyte;

(b) withdrawing the catholyte through a container wherein said container retains a volume of catholyte equal to the volume of the anolyte used in step (a);

(c) adding a regenerating solution to said catholyte not retained in said container in step (b) whereby the composition is approximately that before said use in processing a silver halide photographic light-sensitive material and before said electrolysis;

(d) using the regenerated catholyte not retained in said container in processing a silver halide photographic light-sensitive material;

(e) discharging the anolyte;

(f) charging the anodic cell with the retained catholyte from step (b);

(g) charging the cathodic cell with the fixing solution from step (d); and (h) subjecting the electrolytic cell resulting from steps (f) and (g) to electrolysis as in step (a)

wherein the anolyte, present as used fixing solution in the anodic cell in step (a) and as charged catholyte in step (f), contains ammonium ion.

14. The process according to claim 13, wherein the electrolytic cell is made of an insulating material.

15. The process according to claim 14 wherein the insulating material is a synthetic resin.

16. The process according to claim 13, wherein silver metal is recovered from the cathodic cell after step (b) and before step (g).

17. The process according to claim 13, wherein the volume of the added regenerating solution, the volume of the anolyte and the volume of the catholyte retained in step (b) are equal.

18. The process according to claim 13, wherein said catholyte in step (a) is circulated during electrolysis between said cathodic cell and a circulation tank.

19. The process according to claim 13, wherein the cathode is made of stainless steel.

20. The process according to claim 13, wherein the anode is made of graphite.

21. The process according to claim 13, wherein the fixing solution in the cathodic and anodic cells contains ammonium thiosulfate.

22. The process according to claim 13, wherein said current density is 0.1 to 0.4 $A/dm^2$.

23. The process according to claim 13, wherein the anolyte in step (a) and the catholyte charged into the anodic cell in step (f) are not stirred during electrolysis.

24. The process according to claim 13, wherein said electrolysis is conducted under constant current.

25. The process according to claim 13, wherein the polymer of said polymer film is selected from the group consisting fo polyvinyl chloride, polystyrene, polysulfone, polyester or polypropylene.

26. The process according to claim 13, wherein the volume ratio of the anolyte present as used fixing solution in the anodic cell in step (a) to the catholyte, present as used fixing solution in the cathodic cell in steps (a) or (g), is 1:about 2 to 1:about 3.

27. The process according to claim 13, wherein the anolyte, present as used fixing solution in the anodic cell in step (a) and as charged catholyte in step (f), contains ammonium ion.

28. The process according to claim 13, wherein sulfite ion is present in the anolyte, present as used fixing solution in the anodic cell in step (a) and as charged catholyte in step (e), and said electrolysis is terminated before the concentration of said sulfite ion reaches zero.

29. The process according to claim 1, wherein the temperature of said electrolysis is between about 5° C. and about 30° C.

30. The process according to claim 13, wherein the temperature of said electrolysis is between about 5° C. and about 30° C.

* * * * *